US009881499B1

(12) United States Patent
Tom

(10) Patent No.: US 9,881,499 B1
(45) Date of Patent: Jan. 30, 2018

(54) TRAFFIC LIGHT DEVICES AND METHODS OF USE

(71) Applicant: Robert C. Tom, Sunnyvale, CA (US)

(72) Inventor: Robert C. Tom, Sunnyvale, CA (US)

( * ) Notice: Subject to any disclaimer, the term of this patent is extended or adjusted under 35 U.S.C. 154(b) by 0 days.

(21) Appl. No.: 15/447,119

(22) Filed: Mar. 2, 2017

(51) Int. Cl.

| | |
|---|---|
| ***G08G 1/07*** | (2006.01) |
| ***G08G 1/085*** | (2006.01) |
| *G08G 1/095* | (2006.01) |
| *G08G 1/096* | (2006.01) |
| *G09F 9/33* | (2006.01) |
| *F21V 1/00* | (2006.01) |

(52) U.S. Cl.
CPC ..... *G08G 1/085* (2013.01)

(58) Field of Classification Search
CPC ..... G08G 1/085
USPC ..... 340/916
See application file for complete search history.

(56) References Cited

U.S. PATENT DOCUMENTS

| | | | | |
|---|---|---|---|---|
| 3,480,909 | A | 11/1969 | Hines | |
| 3,529,287 | A | 9/1970 | Southerland | |
| 3,863,207 | A | 1/1975 | Galella | |
| 4,839,647 | A | 6/1989 | Patterson | |
| 5,726,648 | A | 3/1998 | Soon | |
| 6,054,932 | A * | 4/2000 | Gartner | G08G 1/095 340/815.45 |
| 6,087,962 | A | 7/2000 | Rojas | |
| 6,331,824 | B1 | 12/2001 | Firestone | |
| 7,330,130 | B2 | 2/2008 | Bolotin et al. | |
| 2004/0189491 | A1 * | 9/2004 | Aydin | G08G 1/096 340/925 |
| 2006/0092044 | A1 | 5/2006 | Naljotov | |
| 2007/0176791 | A1 | 8/2007 | Bolotin et al. | |
| 2008/0266136 | A1 | 10/2008 | Diba | |
| 2011/0133955 | A1 | 6/2011 | Plazak et al. | |
| 2014/0225752 | A1 | 8/2014 | Lee | |
| 2016/0225257 | A1 * | 8/2016 | Millan | F21S 8/08 |

* cited by examiner

*Primary Examiner* — Jack K Wang

(74) *Attorney, Agent, or Firm* — Franklin & Associates International Inc; Matthew F. Lambrinos

(57) ABSTRACT

Traffic light devices and methods of use are provided herein. A traffic light may include a first lighting element segment that can be activated with a first color, a second lighting element segment that can be activated with a second color or a third color, and a third lighting element segment surrounds the second lighting element segment.

25 Claims, 8 Drawing Sheets

TRAFFIC LIGHT DEVICES AND METHODS OF USE

FIELD OF THE PRESENT DISCLOSURE

Embodiments of the present disclosure are directed to traffic light devices, and more specifically, but not by limitation to traffic light devices and methods of use that improve driver apprehension of traffic light phases and reduce zone of indecision issues arising from traffic light phase transitions.

SUMMARY

According to some embodiments, the present disclosure is directed to a method for controlling a traffic light, comprising: activating a first lighting element segment of a traffic light for a first time duration with a first color, deactivating the first lighting element segment and activating a second lighting element segment of the traffic light for a second time duration with a second color in tandem with activating sectors of a third lighting element segment of the traffic light for the same second time duration with the same second color, activating sectors of a third lighting element segment of the traffic light that surrounds the second lighting element segment during the second time duration with a third color, changing the second lighting element segment from the second color to the third color for a third time duration, and deactivating the sectors of the third lighting element segment and the second lighting element segment.

Other embodiments of this aspect include corresponding computer systems, apparatus, and computer programs recorded on one or more computer storage devices, each configured to perform the actions of the methods. Other embodiments can be expressed in means-for and/or step-for configurations.

According to some embodiments, the present disclosure is directed to a traffic light, comprising: a first lighting element segment that that activates with a first color, a second lighting element segment that activates with a second color or a third color, and a third lighting element segment that rings the second lighting element segment, the third lighting element segment transitionally activates between the second color and the third color.

According to some embodiments, the present disclosure is directed to a traffic light system, comprising: a traffic light, comprising: a first lighting element segment that can be activated with a first color, a second lighting element segment that can be activated with a second color or a third color, and a third lighting element segment that surrounds the second lighting element segment that can be activated with a second color or a third color. The system also comprises a traffic light controller that activates: the first lighting element segment of the traffic light for a first time duration with the first color, deactivates the first lighting element segment and activates the second lighting element segment of the traffic light for a second time duration with the second color, activates sectors of the third lighting element segment of the traffic light that surrounds the second lighting element segment during the same second time duration with the same second color, changes sectors of the third lighting element segment of the traffic light that surrounds the second lighting element segment during the second time duration from the second color to the third color, changes the second lighting element segment from the second color to the third color for a third time duration, deactivates the sectors of the third lighting element segment and the second lighting element segment.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1:
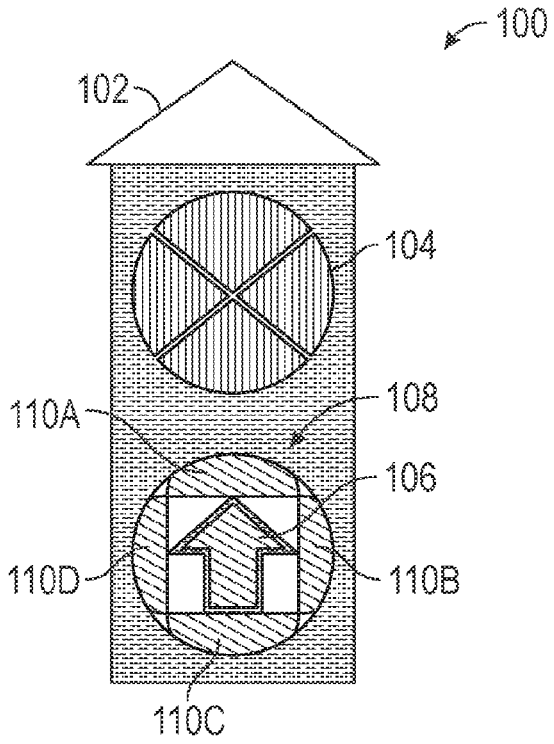
FIG. 1 is a front elevation view of an example traffic light constructed in accordance with the present disclosure.

While this technology is susceptible of embodiment in many different forms, there is shown in the drawings (and will herein be described in detail) several specific embodiments with the understanding that the present disclosure is to be considered as an exemplification of the principles of the technology and is not intended to limit the technology to the embodiments illustrated.

The traffic light devices and systems of the present disclosure improve driver apprehension of traffic light phases and reduce "Indecision Zone" issues arising from traffic light phase transitions. In more detail these traffic light devices and systems reduce stress that drivers experience when they enter what is referred to herein as the "Indecision Zone": The "Indecision Zone" is a period of time when a traffic light is transitioning from a green phase, to a yellow phase, and then further to a red phase.

The traffic light devices disclosed herein solve various problems that exist. These traffic light devices focus on solving two drawbacks with current traffic lights. These traffic light devices solve a problem that includes the lack of information being relayed to drivers about the time frame for the "Indecision Zone" at traffic light stops. This lack of information can cause people to make poor decisions when the yellow light comes, resulting in problems and accidents when they either speed up to beat the light change or stop too early.

The traffic light devices also solve problems with a lack of contrast between different lights for drivers who are impaired with color vision deficiency and/or poor vision.

Under these conditions, relying solely on the position of the light is dangerous if only the radiance of the traffic light can be accurately discerned.

The traffic light devices of the present disclosure provide more real-time information to drivers, removing much uncertainty about the "Indecision Zone". The traffic light devices of the present disclosure also improve contrast between different stages of the traffic light. Every stage is visually distinct and does not solely rely on the color or position of the light to inform drivers.

In some embodiments, traffic light devices comprise a transition sequence from an end of the green phase to a beginning of the red phase while counting down remaining time for a yellow phase in order to provide drivers with additional time (seven to ten seconds, for example) to make an informed decision about stopping or proceeding.

The disclosed traffic light devices employ configurations of LED lights for improved contrast for people impaired by color blindness and/or poor vision. In one embodiment there are two possible light sources in the standard set up, rather than three. Each stage of the traffic cycle executed by the traffic light devices is made more distinct, and is divided into four distinct stages rather than three, making it more clear what stage is currently being displayed at any given time. People no longer have to rely primarily on the color of the light in order to distinguish its phase.

The disclosed traffic light devices can still "fail safely" like a traditional traffic light because the traffic light devices comprise at least two distinct light sources. Thus, if something should fail with the traffic light, at least one of the lights may still be used at reduced efficiency to communicate with drivers until it can be properly fixed.

These traffic lights can benefit elderly, disabled, inexperienced, or unfamiliar drivers compared with traditional traffic lights, as drivers that fit these categories may have reduced motor skills and/or reflexes, lack experience as drivers, and/or be unfamiliar with the timing of traffic lights in an area that is new to them.

In some embodiments, the disclosed traffic light devices are more cost efficient than traditional traffic lights.

By combining the yellow light and green light into one housing, costs are reduced relative to the overall material cost of a "signal light stack" in the traffic light. A reduction in material also reduces the weight of the traffic light, meaning that less material is needed for supports to hold and mount the traffic light.

In some embodiments, the amount of bulbs used by a combined yellow and green light are reduced by forming an arrow shape and broken outer ring rather than a complete circle.

The electricity consumption of the traffic light is reduced in three ways. Because the yellow and green light are housed in the same bulb casing, the energy efficiency of switching from the yellow phase to the green phase is increased. Less activated bulbs means less energy being used whenever the lights are on during each stage. This is due to the shape of an arrow and broken ring used for the yellow and green light, as well as any symbols created by unlit bulbs (e.g., an X) in the red light.

Finally, the final few seconds (typically four seconds) of having the green light on will utilize the yellow light bulbs to varying degrees (e.g., in sequential staging), which requires less electricity than the green light bulbs because yellow light is generated at a lower wavelength intensity than green light.

These features also result in less environmental impact due to reductions in material usage, increases in energy efficiencies, and an overall decrease in light pollution.

The traffic light devices of the present disclosure also provide compatibility advantages. Rather than use new or unfamiliar shapes or colors, these traffic light devices reuse those which drivers are universally familiar with (e.g., circles, spheres, Xs, and arrows for the shapes and red, yellow, and green for the colors respectively).

The traffic light devices of the present disclosure can replace or supplement expensive Red Light Traffic Cameras, as well as replace or supplement other currently used methods of alleviating the stress that drivers feel while driving, such as "advance loops" or "crucial lines".

Traffic light devices of the present disclosure can be used with both pre-set traffic systems that are set up beforehand and real-time traffic systems that adapt to traffic conditions as new data is processed throughout the day. For example, green, yellow, and red phases can be adapted to changes in traffic conditions such as vehicle speeds and traffic flow.

FIG. 1 illustrates an example traffic light 100 constructed in accordance with the present disclosure. The traffic light 100 comprises a housing 102 that comprises a first lighting element segment 104, a second lighting element segment 106, and a third lighting element segment 108. Each of the segments 104, 106, and 108 is illustrated in an activated state for purposes of description.

The first lighting element segment 104 is comprised of a plurality of elements such as light emitting diodes (LEDs), although other light producing elements can also likewise be utilized. The LEDs used may be capable of displaying one or more colors.

In some embodiments, the plurality of elements can be activated with a first color, such as red. The plurality of elements can also be selectively controlled such that a portion of the plurality of elements is illuminated with a first color and a second portion is illuminated with a second color. As illustrated in FIG. 1, the plurality of elements is illuminated in red while a portion of the plurality of elements is illuminated in a second color such as white to form a symbol, such as an X.

The second lighting element segment 106 comprises a plurality of elements such as LEDs that can be arranged into any desired shape such as a circle or arrow. The second lightning element segment 106 can be disposed in a linear alignment with the first lighting element segment 104.

The third lighting element segment 108 surrounds the second lightning element segment 106 and is also comprised of a plurality of plurality of elements such as light emitting diodes (LEDs). The third lighting element segment 108 comprises sectors 110A-D, which ring or surround the second lightning element segment 106. While the third lighting element segment 108 displayed comprises four sectors 110A-D, the third lighting element segment 108 can comprise fewer or additional sectors as desired.

In one embodiment the first lighting element segment 104 comprises LEDs having a first color. The second lighting element segment 106 comprises LEDs that can display two or more colors, and the third lighting element segment 108 also comprises LEDs that can display two or more colors.

Figure 2:
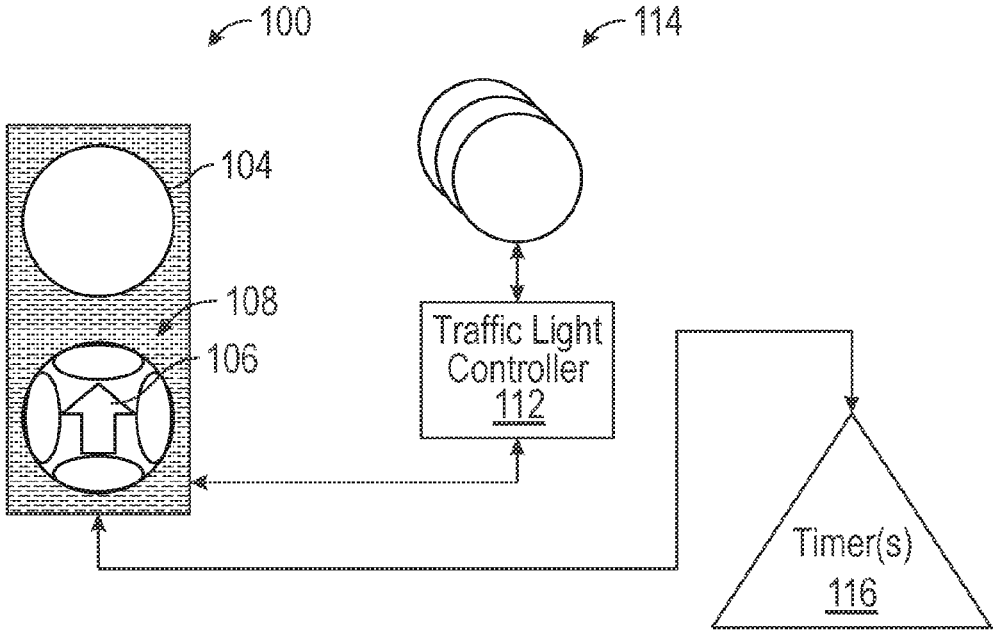
FIG. 2 is a schematic view of an example traffic light constructed in accordance with the present disclosure.

FIG. 2 is a schematic view of the traffic light device 100 which comprises a traffic light controller 112. The traffic light controller 112 comprises a specific purpose computing device such as the computing system illustrated in FIG. 9. The traffic light controller 112 can comprise a microprocessor that is programed to control operations of the first lighting element segment 104, the second lighting element segment 106, and the third lighting element segment 108. The traffic light controller 112 can comprise any of the additional components of the computing system of FIG. 9 as well.

In one embodiment the traffic light controller 112 is collocated or integrated within the housing 102 of the traffic light device 100. In another embodiment the traffic light controller 112 can be remotely located from the traffic light device 100 and control the traffic light device 100. In one embodiment the traffic light controller 112 is disposed within a traffic light equipment unit, such as a service box that is disposed near an intersection where one or more traffic light devices are located. Thus, the traffic light controller 112 can be used to control multiple traffic light devices. In one embodiment, the traffic light controller 112 can control the traffic light device 100 by setting and resetting timers 116 that activate and deactivate individual parts of the segments 104, 106, and 108 as required to accomplish the light sequencing methods described herein.

Thus, the traffic light controller 112 can alternatively control one or more timers 116 that are configured to operate the segments in an ordered pattern. In one embodiment the timer 116 is integrated into the red light component such as the first lighting element segment 104 but the timer 116 can control the operations of the second lighting element segment 106 and the optionally the third lighting element segment 108. The traffic light controller 112 would control the bulbs, circuits, timers, sensors, and other similar components of these element segments 104-108.

The traffic light device 100 also comprises one or more traffic sensors 114 that are configured to sense or detect vehicle speed and stopping distance of vehicles. The traffic light controller 112 can receive input from the one or more traffic sensors 114 to selectively control operation of one or more of the segments 104, 106, and 108. The traffic light controller 112 selectively adjusts time durations for any of the segments 104, 106, and 108, as will be discussed in greater detail below.

As mentioned above, the timer 116 can be integrated into the red light component (referred to generally as the first lighting element segment) in the sense that the traffic light controller 112 would use the same components for both, to perform their distinct functions. In other words, the components that are needed by the traffic light controller 112 to utilize the timer 116 are the same as those that would be used to execute the functions of the red light component (e.g., the bulbs, circuits, timers, sensors, etc.). This is in contrast to the many designs that currently utilize a timer that typically set the red light element up as an overall separate component from any of the other lighting element segments.

Figure 3:
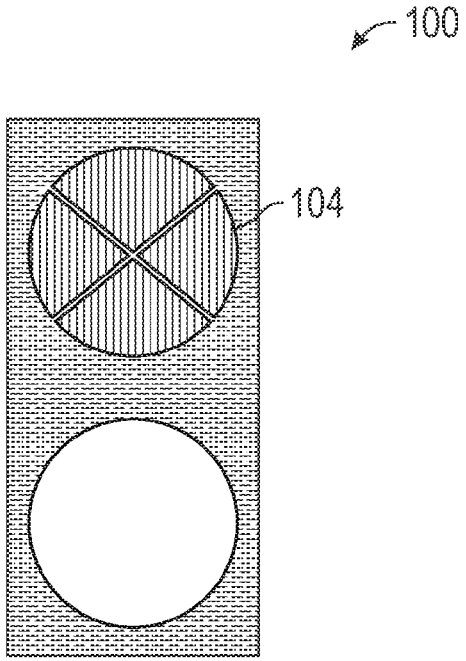
FIG. 3 illustrates a first lighting element segment of a traffic light illuminated.

Referring now to FIGS. 2-6B collectively, the traffic light controller 112 is configured in some embodiments to control the operation of the various segments of the traffic light device 100 to effectuate reduction in indecision zone issues and increase visibility to drivers. In FIG. 3, the traffic light controller 112 is configured to activating the first lighting element segment 104 of the traffic light device 100 for a first time duration with a first color, such as red. The first lighting element segment 104 comprises a circular configuration of lighting elements such as LEDs.

In one embodiment the traffic light controller 112 controls the lighting elements of the first lighting element segment 104 such that a portion of the lighting elements are colored with a contrasting color to form a symbol. In one embodiment the symbol is an X. The contrasting color can comprise any color such as white.

The length of the first time duration can include any time period such as seconds or minutes.

Figure 4:
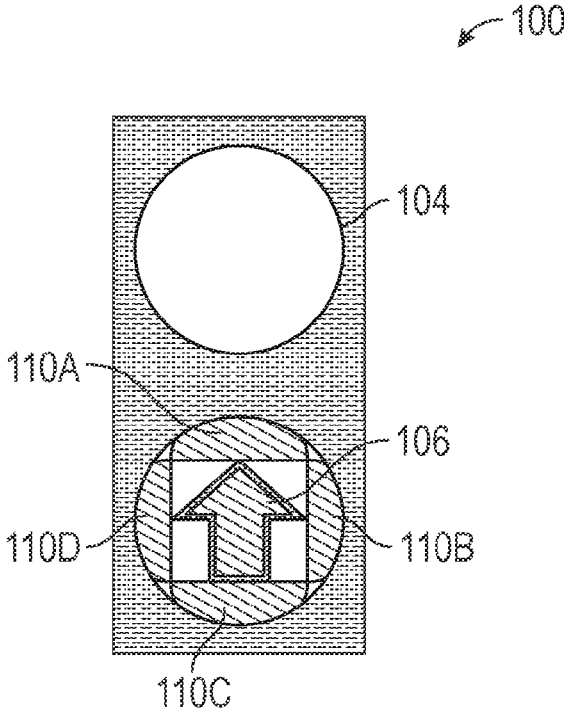
FIG. 4 illustrates a second lighting element segment and a third lighting element segment of a traffic light illuminated.
Figure 5A:
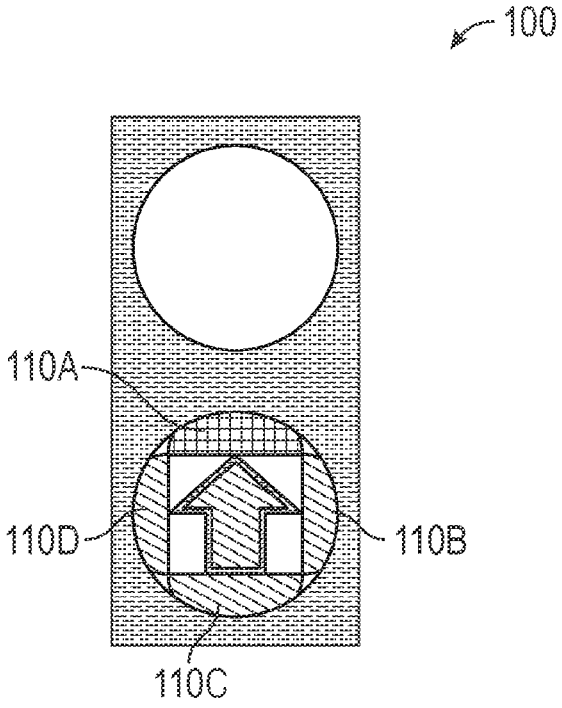
FIGS. 5A-5D collectively illustrate the third lighting element segment of a traffic light being sequentially color changed.
Figure 5B:
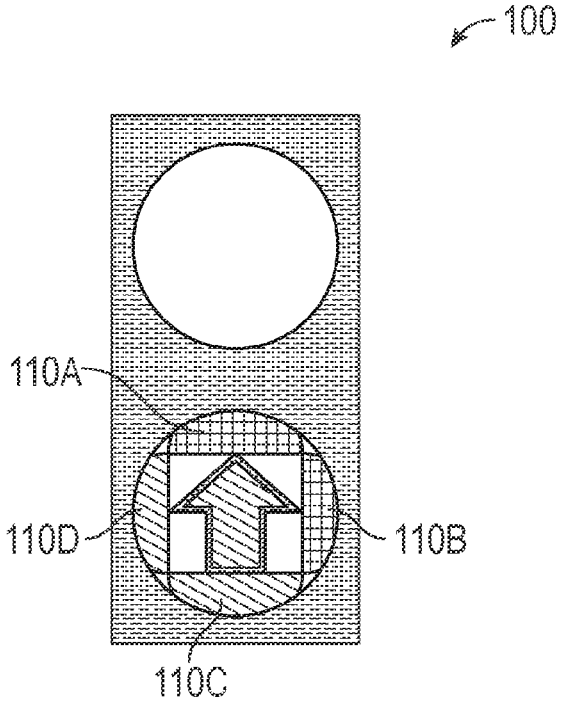
Figure 5C:
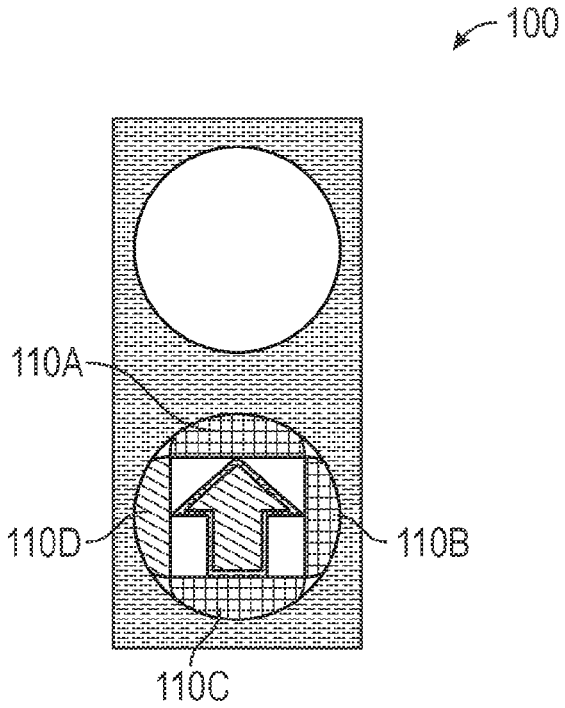
Figure 5D:
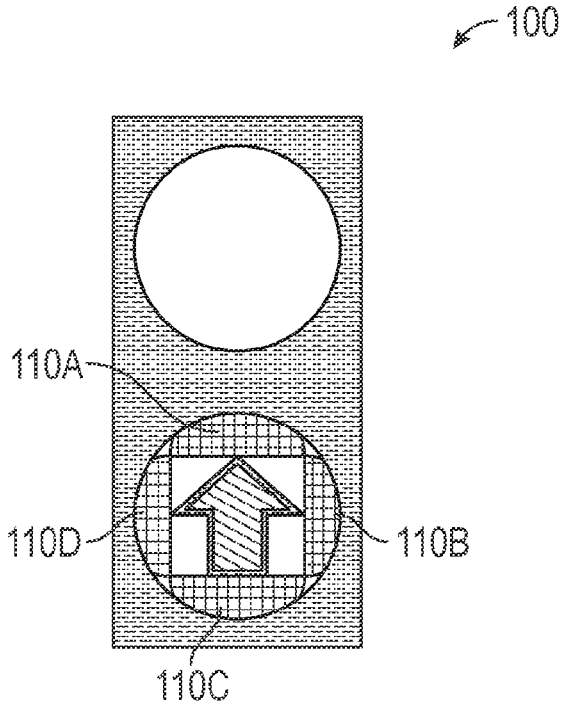

Upon expiration of the first time duration the traffic light controller 112 deactivates the first lighting element segment 104. The traffic light controller 112 then activates the second lighting element segment 106 of the traffic light device 100 for a second time duration using a second color. In one embodiment the second color is green as illustrated in FIG. 4.

In some embodiments the traffic light controller 112 activates the sectors 110A-D of the third lighting element segment 108 as well with the second color (e.g., green). As the second time duration approaches expiration the traffic light controller 112 begins to change the color of the sectors 110A-D of the third lighting element segment 108 of the traffic light device 100. In one embodiment the sectors 110A-D change from the second color (e.g., green) to a third color such as yellow (see FIGS. 5A-5D).

In some embodiments, the sectors 110A-D remain in a deactivated state during a portion of the second time duration and will only begin changing to the third color as the second time duration approaches expiration.

When the second time duration expires and the sectors 110A-D have been changed to the third color the second lighting element segment will itself be changed to the third color by the traffic light controller 112. A third time duration then begins.

Figures 6A, 6B:
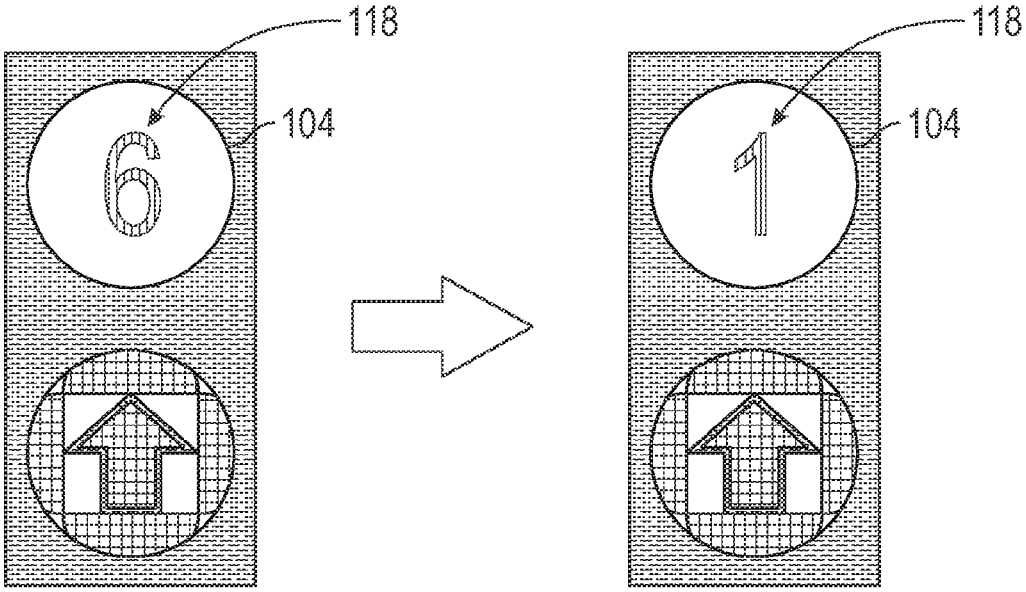
FIGS. 6A-6B collectively illustrate a numerical countdown displayed in the first lighting element segment while the second and third lighting element segments are illuminated in yellow.

During the third time duration the traffic light controller 112 causes display of a countdown of numerical values 118 within the first lighting element segment 104. This countdown can include a countdown of numbers corresponding to remaining seconds of time left in the third time duration as illustrated in FIGS. 6A-6B.

Once the traffic light controller 112 has counted down the third time duration within the first lighting element segment 104 the traffic light controller 112 deactivates the sectors 110A-D of the third lighting element segment 108 as well as the second lighting element segment 106. The traffic light controller 112 then cycles to the first lighting element segment 104 state described above and illustrated in FIG. 3.

In one embodiment, the third time duration is the equivalent of a yellow light phase that is used in a traditional traffic light. The amount of time that a yellow light is turned on for is based upon the speed that vehicles are expected to be moving at (set speed limit in some embodiments), and the expected stopping distance that said vehicles would need in order to safely come to a stop, which is based upon their expected traveling speed and road conditions. In some embodiments, vehicle speed can be sensed by camera or radar. Weather conditions that may affect stopping distance can be determined from weather information obtained by the traffic light controller 112. In some embodiments the traffic light 100 can integrate various weather sensors.

The cycle described above is repeated to control traffic flow.

In some embodiments, the traffic light controller 112 activates and/or changes the color of the sectors 110A-D of the third lighting element segment 108 in a progressive or sequential manner. In one embodiment the traffic light controller 112 changes the color of the sector 110A followed by 110B, 110C and 110D. When each of the sectors has been changed the sectors 110A-D remain active until expiration of the third time period. The sector sequence described above is merely an example sequencing method.

Figure 7:
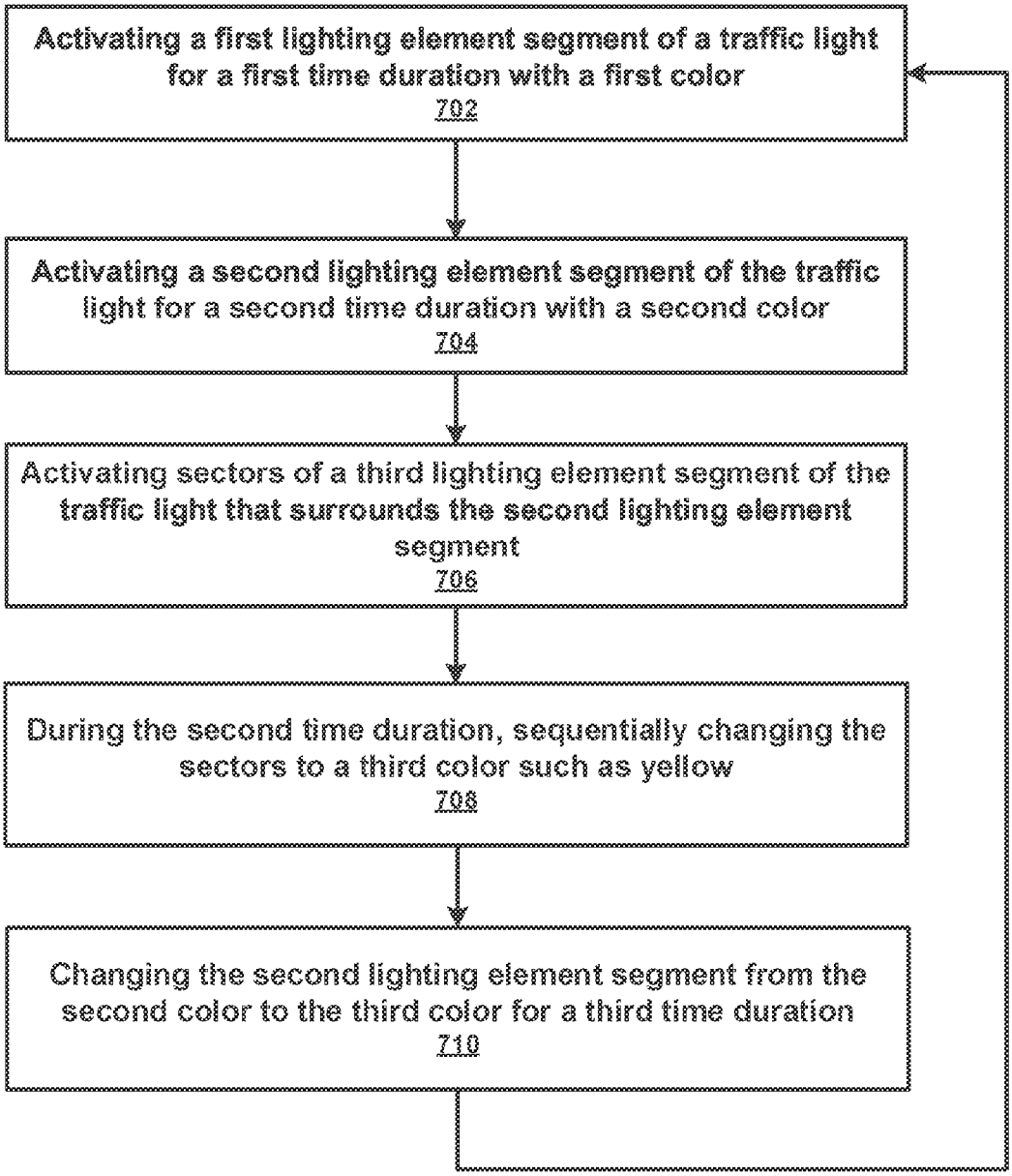
FIG. 7 is a flowchart of an example method of the present disclosure.

FIG. 7 is a flowchart of an example method of the present disclosure. In some embodiments the method includes a step 702 of activating a first lighting element segment of a traffic light for a first time duration with a first color. In one embodiment the first lighting element segment is red.

This phase activates the LED lights in an upper circle shaped red light. The red circle, with an X symbol of unlit LED lights marked through it informs drivers to stop all movement of their vehicles in that particular direction.

When it is time for the flow of traffic to resume, the red light in the first lighting element segment will deactivate and the green light will then activate. Thus, the method includes a step 704 of activating a second lighting element segment of the traffic light for a second time duration with a second color. In one embodiment the second lighting element segment comprises a green arrow.

This phase activates the LED lights in the circular shaped green and/or yellow light. Rather than display the solid green circle that is commonly found in traffic lights, the shape that is displayed is an arrow encompassed by a ring divided into four distinct, equal parts, referred to as sectors. The surrounding ring of sectors provides additional surface area for the light so that drivers will be able to see the symbol at a distance.

In some embodiments the method includes a step 706 of activating sectors of a third lighting element segment of the traffic light that surrounds the second lighting element segment. In one embodiment the sectors are initially green colored.

According to some embodiments, the method comprises a step 708 during the second time duration, sequentially changing the sectors of segment 108 to a third color such as yellow. In one embodiment, when four seconds remain before a change from green to yellow the outer ring of sectors will begin to shift from the green phase to the yellow phase, one part at a time in a clockwise manner, until finally, the arrow changes color as well. This transition phase is primarily an energy saving phase, and secondarily a way to inform drivers of the impending light change from green to yellow.

Thus, the method comprises a step 710 of changing the second lighting element segment from the second color to the third color for a third time duration before the method cycles back to step 702.

Figure 8:
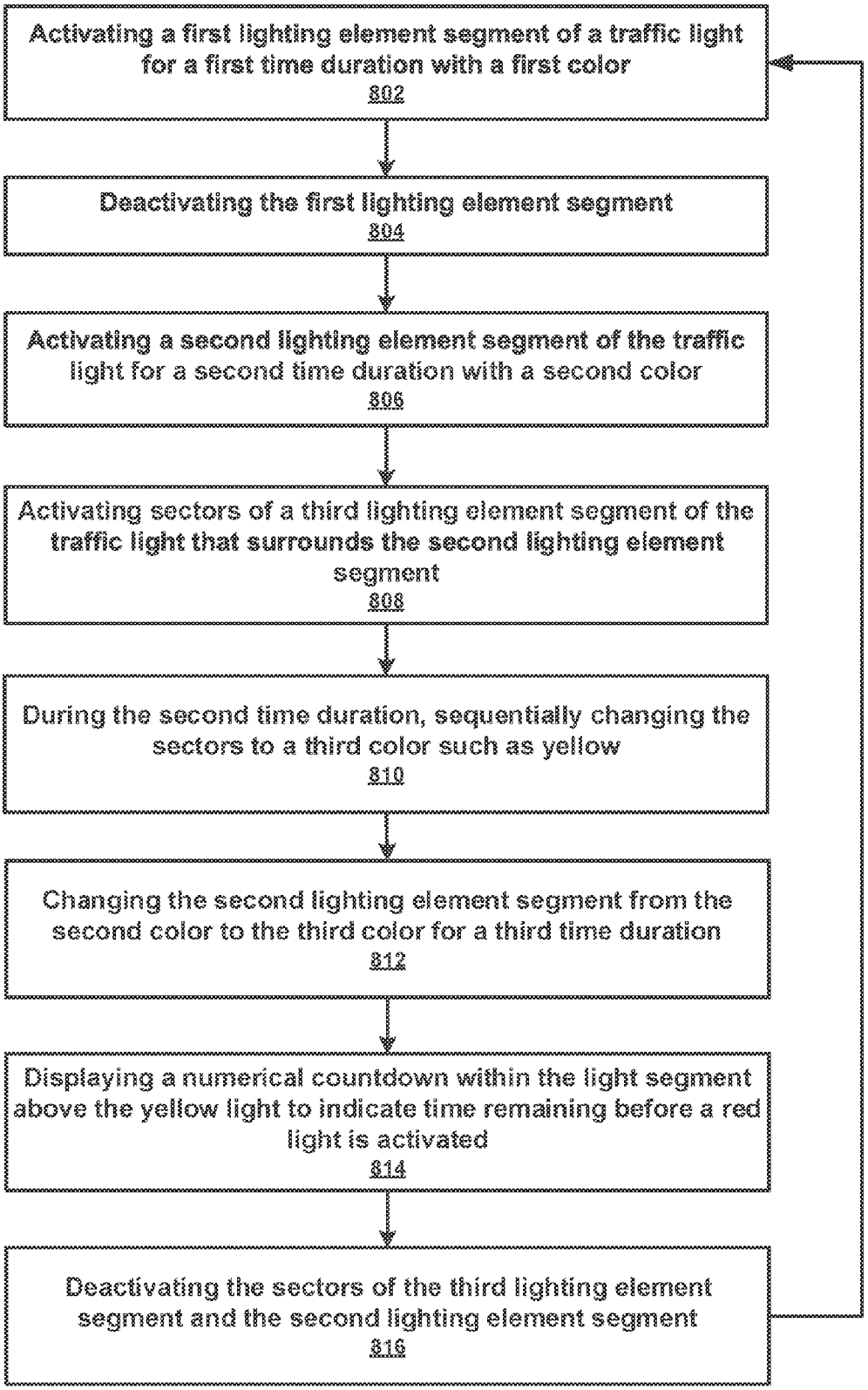
FIG. 8 is a flowchart of another example method of the present disclosure.

FIG. 8 is a flowchart of an example method of the present disclosure. In some embodiments the method includes a step 802 of activating a first lighting element segment of a traffic light for a first time duration with a first color. In one embodiment the first lighting element segment is red.

This phase activates the LED lights in an upper circle shaped red light. The red circle, with an X symbol of unlit LED lights marked through it informs drivers to stop all movement of their vehicles in that particular direction.

When it is time for the flow of traffic to resume, the red light will deactivate and the green light will then activate. Thus, the method includes a step 804 of deactivating the first lighting element segment and a step 806 of activating a second lighting element segment of the traffic light for a second time duration with a second color. In one embodiment the second lighting element segment comprises a green arrow.

This phase activates the LED lights in the circular shaped green and/or yellow light. Rather than display the solid green circle that is commonly found in traffic lights, the shape that is displayed is an arrow encompassed by a ring divided into four distinct, equal parts, referred to as sectors. The surrounding ring of sectors provides additional surface area for the light so that drivers will be able to see the symbol at a distance.

In some embodiments the method includes a step 808 of activating sectors of a third lighting element segment of the traffic light that surrounds the second lighting element segment. In one embodiment the sectors are initially green colored.

According to some embodiments, the method comprises a step 810 of during the second time duration, sequentially changing the sectors to a third color such as yellow. In one embodiment, when four seconds remain before a change from green to yellow the outer ring of sectors will begin to shift from the green phase to the yellow phase, one part at a time in a clockwise manner, until finally, the arrow changes color as well. This transition phase is primarily an energy saving phase, and secondarily a way to inform drivers of the impending light change from green to yellow.

Thus, the method comprises a step 812 changing the second lighting element segment from the second color to the third color for a third time duration.

In some embodiments, during this third time duration the method includes a step 814 of displaying a numerical countdown within the light segment above the yellow light to indicate time remaining before a red light is activated.

Thus, this phase involves not just the yellow light being active, but also the numerical timer integrated into the red light to become active. The timer counts down the remaining time that the yellow light will be active and allows drivers to visually see the change. The time will typically range from three to six seconds depending on traffic conditions. This display of a yellow phase countdown is effective to reduce and/or eliminate the indecision zone normally associated with yellow light transitions which are untimed or unexpected from the perspective of a driver.

In one embodiment the method includes a step 816 of deactivating the sectors of the third lighting element segment and the second lighting element segment. The method then cycles back to step 802.

Figure 9:
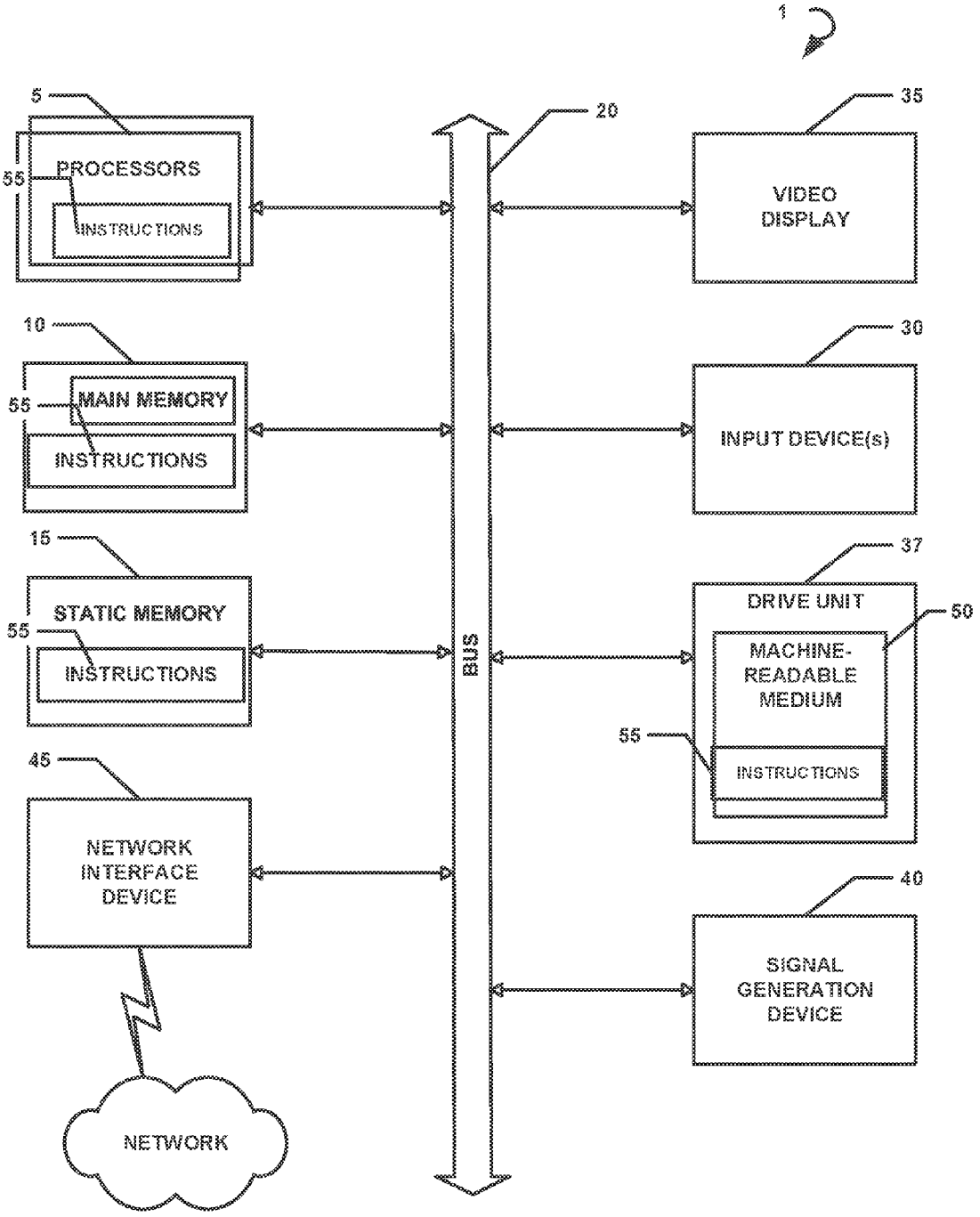
FIG. 9 is a schematic diagram of an example computing system that can be utilized to practice aspects of the present disclosure.

FIG. 9 is a diagrammatic representation of an example machine in the form of a computer system 1, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a robotic construction marking device, a base station, a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1 includes a processor or multiple processors 5 (e.g., a central processing unit (CPU), a graphics processing unit (GPU), or both), and a main memory 10 and static memory 15, which communicate with each other via a bus 20. The computer system 1 may further include a video display 35 (e.g., a liquid crystal display (LCD)). The computer system 1 may also include an alphanumeric input device(s) 30 (e.g., a keyboard), a cursor control device (e.g., a mouse), a voice recognition or biometric verification unit (not shown), a drive unit 37 (also referred to as disk drive unit), a signal generation device 40 (e.g., a speaker), and a network interface device 45. The computer system 1 may further include a data encryption module (not shown) to encrypt data.

The drive unit 37 includes a computer or machine-readable medium 50 on which is stored one or more sets of instructions and data structures (e.g., instructions 55) embodying or utilizing any one or more of the methodologies or functions described herein. The instructions 55 may also reside, completely or at least partially, within the main memory 10 and/or within the processors 5 during execution thereof by the computer system 1. The main memory 10 and the processors 5 may also constitute machine-readable media.

The instructions 55 may further be transmitted or received over a network via the network interface device 45 utilizing any one of a number of well-known transfer protocols (e.g., Hyper Text Transfer Protocol (HTTP)). While the machine-readable medium 50 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

Not all components of the computer system 1 are required and thus portions of the computer system 1 can be removed if not needed, such as Input/Output (I/O) devices (e.g., input device(s) 30). One skilled in the art will recognize that the Internet service may be configured to provide Internet access to one or more computing devices that are coupled to the Internet service, and that the computing devices may include one or more processors, buses, memory devices, display devices, input/output devices, and the like. Furthermore, those skilled in the art may appreciate that the Internet service may be coupled to one or more databases, repositories, servers, and the like, which may be utilized in order to implement any of the embodiments of the disclosure as described herein.

As used herein, the term "module" may also refer to any of an application-specific integrated circuit ("ASIC"), an electronic circuit, a processor (shared, dedicated, or group) that executes one or more software or firmware programs, a combinational logic circuit, and/or other suitable components that provide the described functionality.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photosensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A method for controlling a traffic light, comprising:

activating a first lighting element segment of a traffic light for a first time duration with a first color;

activating a second lighting element segment of the traffic light as well as a plurality of distinct sectors forming a broken outer ring of a third lighting element segment of the traffic light that surrounds the second lighting element, for a second time duration with a second color;

incrementally changing the plurality of distinct sectors of the third lighting element segment during the second time duration to a third color such that with each incremental change, one addition sector is changed until all the plurality of sectors in the broken outer ring have changed to the third color; and after each of the plurality of distinct sectors having been incrementally changed, changing the second lighting element segment from the second color to the third color for a third time duration.

2. The method according to claim 1, further comprising repeating the method to control traffic flow.

3. The method according to claim 1, wherein sectors of the third lighting element segment are activated in a timed sequence.

4. The method according to claim 1, wherein after all the sectors are activated the second lighting element segment is changed to the third color until an end of the third time duration.

5. The method according to claim 1, wherein the sectors of the third lighting element segment are initially colored with the second color, further wherein the sectors of the third lighting element segment are changed to the third color during the third time duration.

6. The method according to claim 1, further comprising activating a numerical countdown in the first lighting element segment during the third time duration.

7. The method according to claim 1, wherein the third time duration is based on any of vehicle speed and stopping distance of vehicles.

8. A traffic light, comprising:

a first lighting element segment that is configured to activate with a first color;

a second lighting element segment that is configured to activate with a second color or a third color; and a third lighting element segment that rings the second lighting element segment, wherein the third lighting element segment comprises a plurality of distinct sectors forming a broken outer ring that surrounds the second lighting element segment;

wherein the third lighting element segment is configured to transitionally activate between the second color and the third color, wherein said first lighting element segment is configured to activate for a first time duration with a first color;

wherein said second lighting element segment of the traffic light as well as said plurality of distinct sectors are configured to activate for a second time duration with a second color;

wherein said plurality of distinct sectors of the third lighting element segment is configured to incrementally change during the second time duration to a third color such that with each incremental change, one addition sector is changed until all the plurality of sectors in the broken outer ring have changed to the third color; and wherein said second lighting element segment is further configured to change from the second color to the third color for a third time duration after each of the plurality of distinct sectors having been incrementally changed.

9. The traffic light according to claim 8, wherein the third lighting element segment comprises sectors that form a ring around the second lighting element segment.

10. The traffic light according to claim 8, further comprising a timer that controls operation of the second lighting element segment and the third lighting element segment.

11. A traffic light system, comprising:

a traffic light, comprising:

a first lighting element segment that can be activated with a first color;

a second lighting element segment that can be activated with a second color or a third color; and a third lighting element segment comprising a plurality of distinct sectors forming a broken outer ring that surrounds the second lighting element segment; and a traffic light controller that:

activates the first lighting element segment of the traffic light for a first time duration with the first color;

deactivates the first lighting element segment;

activates the second lighting element segment of the traffic light for a second time duration with the second color;

incrementally changes the plurality of distinct sectors of the third lighting element segment of the traffic light that surrounds the second lighting element segment during the second time duration with a third color, such that with each incremental change, one addition sector is changed until all the plurality of sectors in the broken outer ring have changed to the third color;

changes the second lighting element segment from the second color to the third color for a third time duration; and deactivates the sectors of the third lighting element segment and the second lighting element segment.

12. The traffic light system according to claim 11, wherein the traffic light controller is disposed within a housing that comprises the first lighting element segment, the second lighting element segment, and the third lighting element segment.

13. The traffic light system according to claim 11, wherein the first lighting element segment comprises a circular configuration of lighting elements.

14. The traffic light system according to claim 13, wherein the traffic light controller controls the lighting elements such that a portion of the lighting elements are colored with a fourth color, further wherein the portion forms a symbol.

15. The traffic light system according to claim 11, wherein the traffic light controller selectively changes the sectors of the third lighting element segment from the second color to the third color in a timed sequence.

16. The traffic light system according to claim 11, wherein the traffic light controller controls the second lighting element segment to change the second lighting element segment from the second color to the third color when the sectors are all activated.

17. The traffic light system according to claim 11, wherein the traffic light controller controls activates a numerical countdown in the first lighting element segment during the third time duration.

18. The traffic light system according to claim 11, wherein the traffic light controller controls changes the first lighting element segment to the first color upon expiration of the third time duration and deactivates the second lighting element segment and the third lighting element segment.

19. A traffic light controller for a traffic light, the traffic light comprising a first lighting element segment that can be activated with a first color; a second lighting element segment that can be activated with a second color or a third color; and a third lighting element segment that is activated with a second color or a third color, the third lighting element segment comprising distinct sectors that form a broken outer ring that surrounds the second lighting element that surrounds the second lighting element segment; the controller comprising an electronic unit or processor configured to:

activate the first lighting element segment of the traffic light for a first time duration with the first color;

deactivate the first lighting element segment;

activate the second lighting element segment of the traffic light for a second time duration with the second color;

incrementally change the distinct sectors of the third lighting element segment of the traffic light that surrounds the second lighting element segment during the second time duration with a third color, wherein with each incremental change, one addition sector is changed until all the distinct sectors in the broken outer ring have changed to the third color; and change the second lighting element segment from the second color to the third color for a third time duration; and, deactivate the sector of the third lighting element segment and the second lighting element segment.

20. The controller according to claim 19, wherein said controller is further configured to repeat activation and deactivation of said element segments and sectors thereof.

21. The controller according to claim 19, wherein said controller is configured to activate sectors of the third lighting element segment in a sequence.

22. The controller according to claim 19, wherein said controller is configured to activate sectors of the third lighting element segment in a timed sequence.

23. The controller according to claim 19, wherein said controller is configured to change, after all the sectors are activated, the second lighting element segment to the third color until an end of the third time duration.

24. The controller according to claim 19, wherein the controller is configured to change the sectors of the third lighting element segment from a second color to the third color during the third time duration.

25. The controller according to claim 19, wherein the controller is configured to activate a numerical countdown in the first lighting element segment during the third time duration.

* * * * *